US010047590B2

(12) United States Patent
Donderici et al.

(10) Patent No.: US 10,047,590 B2
(45) Date of Patent: Aug. 14, 2018

(54) FERROFLUID TOOL FOR INFLUENCING ELECTRICALLY CONDUCTIVE PATHS IN A WELLBORE

(71) Applicant: HALLIBURTON ENERGY SERVICES, INC., Houston, TX (US)

(72) Inventors: Burkay Donderici, Houston, TX (US); Baris Guner, Kingwood, TX (US); George David Goodman, Houston, TX (US); Wesley Neil Ludwig, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 489 days.

(21) Appl. No.: 14/424,351

(22) PCT Filed: Dec. 30, 2013

(86) PCT No.: PCT/US2013/078253
§ 371 (c)(1),
(2) Date: Feb. 26, 2015

(87) PCT Pub. No.: WO2015/102563
PCT Pub. Date: Jul. 9, 2015

(65) Prior Publication Data

US 2016/0032688 A1 Feb. 4, 2016

(51) Int. Cl.
*E21B 47/09* (2012.01)
*E21B 33/124* (2006.01)
(Continued)

(52) U.S. Cl.
CPC ..... *E21B 41/00* (2013.01); *E21B 33/124* (2013.01); *E21B 47/0905* (2013.01); *E21B 47/1015* (2013.01)

(58) Field of Classification Search
CPC ..... E21B 33/124; E21B 33/10; E21B 41/00; E21B 47/1015; E21B 47/0905; H01F 1/44–1/447
(Continued)

(56) References Cited

U.S. PATENT DOCUMENTS 2,851,109 A * 9/1958 Spearow ..... E21B 33/124 166/177.5
3,984,918 A 10/1976 Chaney
(Continued)

FOREIGN PATENT DOCUMENTS

GB 2222680 3/1990
PL 397294 6/2013
(Continued)

OTHER PUBLICATIONS

Dickstein et al., Labyrinthine Pattern Formation in Magnetic Fluids, Science, New Series, vol. 261, No. 5124, Aug. 20, 1993, pp. 1012-1015.
(Continued)

*Primary Examiner* — George S Gray
(74) *Attorney, Agent, or Firm* — Kilpatrick Townsend & Stockton LLP

(57) ABSTRACT

A tool for influencing electrically conductive paths using ferrofluids in a downhole system. The downhole system can include a tool body, a source of ferrofluid, and a magnet. The magnet can provide a magnetic field that influences an electrically conductive path within an annulus between the tool body and a wellbore formation by arranging the ferrofluid from the source in the annulus.

21 Claims, 6 Drawing Sheets

(51) Int. Cl.
*E21B 41/00* (2006.01)
*E21B 47/10* (2012.01)

(58) Field of Classification Search
USPC ..... 166/381
See application file for complete search history.

(56) References Cited

U.S. PATENT DOCUMENTS 4,035,718 A 7/1977 Chandler
4,350,955 A 9/1982 Jackson et al.
4,353,249 A * 10/1982 Lagus ..... E21B 47/10 73/152.31
4,356,098 A 10/1982 Chagnon
4,424,974 A 1/1984 Mitsuya et al.
4,444,398 A 4/1984 Black et al.
4,502,700 A 3/1985 Gowda et al.
4,526,379 A 7/1985 Raj
4,604,222 A 8/1986 Borduz et al.
4,604,229 A * 8/1986 Raj ..... F16C 33/1035 252/503
4,630,243 A 12/1986 MacLeod
4,630,943 A 12/1986 Stahl et al.
4,691,774 A 9/1987 Nelson
4,802,534 A 2/1989 Larson et al.
4,845,988 A 7/1989 Russell et al.
4,865,334 A 9/1989 Raj et al.
4,991,438 A 2/1991 Evans
5,007,513 A 4/1991 Carlson
5,092,611 A 3/1992 Ehmsen et al.
5,429,000 A 7/1995 Raj et al.
5,452,520 A 9/1995 Raj et al.
5,474,302 A 12/1995 Black et al.
5,475,309 A 12/1995 Hong et al.
5,780,741 A 7/1998 Raj
5,850,624 A 12/1998 Gard et al.
6,216,787 B1 4/2001 Ruttley
6,250,848 B1 * 6/2001 Moridis ..... B09C 1/00 166/292
6,257,356 B1 7/2001 Wassell
6,290,894 B1 9/2001 Raj et al.
6,305,694 B1 10/2001 Yamazumi et al.
6,681,849 B2 1/2004 Goodson, Jr.
6,817,415 B2 11/2004 Orban et al.
7,021,406 B2 4/2006 Zitha
7,032,670 B2 4/2006 Zitha
7,063,146 B2 6/2006 Schultz et al.
7,063,802 B2 6/2006 Tsuda et al.
7,159,675 B2 1/2007 Eigner et al.
7,204,581 B2 4/2007 Peeters
7,219,752 B2 5/2007 Wassell et al.
7,428,922 B2 9/2008 Fripp et al.
7,743,825 B2 6/2010 O'Malley et al.
7,763,175 B2 7/2010 DeCoster et al.
7,779,933 B2 8/2010 Sihler et al.
7,950,672 B2 5/2011 Shimazaki et al.
8,056,246 B1 11/2011 Hopper et al.
8,136,594 B2 3/2012 Streich et al.
8,230,918 B2 7/2012 Ameen
8,269,501 B2 9/2012 Schmidt et al.
8,286,705 B2 10/2012 Ocalan et al.
8,328,199 B2 12/2012 Oshita
8,360,170 B2 1/2013 Leuchtenberg
8,419,019 B2 4/2013 Kung
8,689,875 B2 4/2014 Dudley et al.
8,936,095 B2 1/2015 Ocalan et al.
9,206,659 B2 12/2015 Zhang et al.
9,512,698 B2 12/2016 Donderici et al.
9,551,203 B2 1/2017 Meinke et al.
2003/0166470 A1 9/2003 Fripp et al.
2004/0084184 A1 * 5/2004 Orban ..... E21B 33/13 166/292
2005/0006020 A1 1/2005 Jose Zitha et al.
2005/0109512 A1 5/2005 Zitha
2005/0274524 A1 12/2005 Silguero
2008/0290876 A1 11/2008 Ameen
2009/0008078 A1 1/2009 Patel
2009/0025928 A1 1/2009 Lee
2009/0101364 A1 4/2009 Schafer et al.
2009/0179385 A1 7/2009 Komino et al.
2010/0019514 A1 1/2010 Steinwender
2010/0126716 A1 5/2010 Joseph
2010/0187009 A1 7/2010 Siher et al.
2010/0224360 A1 9/2010 MacDougall et al.
2010/0267594 A1 10/2010 Rana et al.
2011/0056681 A1 3/2011 Khan
2011/0108277 A1 5/2011 Dudley et al.
2011/0186297 A1 8/2011 Zhang et al.
2011/0192573 A1 8/2011 Defretin et al.
2011/0264372 A1 * 10/2011 Ma ..... E21B 47/00 702/6
2011/0297265 A1 12/2011 Kahoe et al.
2011/0297394 A1 12/2011 VanDelden
2013/0020066 A1 1/2013 Ocalan et al.
2013/0091941 A1 4/2013 Huh et al.
2013/0105224 A1 * 5/2013 Donderici ..... G01V 3/30 175/45
2013/0112911 A1 5/2013 Mazyar et al.
2013/0119995 A1 5/2013 Wootten
2013/0139565 A1 6/2013 Hedtke
2013/0169278 A1 7/2013 Bittar et al.
2013/0199650 A1 8/2013 Cabot et al.
2014/0239957 A1 8/2014 Zhang et al.
2014/0262268 A1 9/2014 Kageler
2015/0013985 A1 1/2015 Parsche
2015/0034332 A1 2/2015 Merron
2015/0315868 A1 11/2015 Fripp et al.
2015/0345250 A1 12/2015 Murphree et al.
2016/0010424 A1 1/2016 Van Oort et al.
2016/0040506 A1 2/2016 Goodman et al.
2016/0040507 A1 2/2016 Donderici et al.
2016/0047204 A1 2/2016 Donderici et al.
2016/0145968 A1 5/2016 Marya
2016/0290089 A1 10/2016 Mcmillon et al.
2017/0037710 A1 2/2017 Richards

FOREIGN PATENT DOCUMENTS

WO 2005038189 4/2005
WO 2009142779 11/2009
WO 2001061713 8/2011
WO 2011153524 12/2011
WO 2013012967 4/2013
WO 2015094266 6/2015
WO 2015094274 6/2015
WO 2015102561 7/2015
WO 2015102566 7/2015
WO 2015102568 7/2015

OTHER PUBLICATIONS

Gollwitzer et al., The Surface Topography of a Magnetic Fluid—A Quantitative Comparison Between Experiment and Numerical Simulation, Journal of Fluid Mechanics, May 2006, pp. 1-21.
Grundfos , The Centrifugal Pump, Company Datasheet, Dec. 2003, 128 pages.
Horak et al., Experimental and Numerical Determination of the Static Critical Pressure in Ferrofluid Seals, Journal of Physics: Conference Series, vol. 412, 2013, pp. 1-6.
Pant et al., Synthesis and characterization of ferrofluid-conducting polymer composite, Indian Journal of Engineering and Materials Sciences, vol. 11, Aug. 2004., pp. 267-270.
International Patent Application No. PCT/US2013/078253 , International Search Report and Written Opinion, Sep. 26, 2014, 13 pages.
Raj et al., Advances in ferrofluid technology, Journal of Magnetism and Magnetic Materials, vol. 149, 1995, pp. 174-180.

(56) References Cited

OTHER PUBLICATIONS

Rosenweig , Magnetic Fluid Motion in Rotating Field, Journal of Magnetism and Magnetic Materials, vol. 85, Issues 1-3, Apr. 1990, pp. 171-180.

* cited by examiner

FERROFLUID TOOL FOR INFLUENCING ELECTRICALLY CONDUCTIVE PATHS IN A WELLBORE

CROSS-REFERENCE TO RELATED APPLICATIONS

This is a U.S. national phase under 35 U.S.C. 371 of International Patent Application No. PCT/US2013/078253, titled "Ferrofluid Tool for Influencing Electrically Conductive Paths in a Wellbore" and filed Dec. 30, 2013, the entirety of which is incorporated herein by reference.

TECHNICAL FIELD

The present disclosure relates generally to devices for use in a wellbore in a subterranean formation and, more particularly (although not necessarily exclusively), to tools for influencing electrically conductive paths using ferrofluids.

BACKGROUND

Various devices can be placed in a well traversing a hydrocarbon bearing subterranean formation. Some devices use electrical contacts that can be exposed to fluids in the wellbore. Fluids in the wellbore can be electrically resistive or electrically conductive, either of which can interfere with proper operation of the electrical contacts of a device. In some applications, energy transmitted from the electrical contact can be directed away from an intended target of the electrical energy via conductive wellbore fluid. In other applications, resistive wellbore fluid can be disposed between the contact and the target such that the resistive properties of the wellbore fluid reduce the amount of electrical energy that is directed to the target. Reductions in the amount of electrical energy that is directed to a target—whether due to conductive wellbore fluid or resistive wellbore fluid—can reduce efficiency and accuracy of downhole devices.

DETAILED DESCRIPTION

Certain aspects of the present disclosure are directed to ferrofluid tools for influencing electrically conductive paths using ferrofluids in a wellbore. Ferrofluids, which may also be known as liquid magnets, can include materials whose position, size, and shape can be controlled using external magnetic fields. A ferrofluid tool can include a ferrofluid source for introducing ferrofluid and a magnet for providing a magnetic field. The ferrofluid source or the magnet (or both) can be controlled when the tool is in a wellbore to position the ferrofluid in or near the tool. The ferrofluid can displace wellbore fluid having unknown or problematic electrical characteristics near the electrical contact point. Displacing the wellbore fluid with the ferrofluid, which can have known electrical characteristics, can influence or control the electrical path between the electrical contact point on the tool and a target electrical contact location.

For example, a sensor on a wellbore tool can gather readings by establishing electrical contact with a wall of the wellbore formation. The wellbore wall formation, however, can be rough and have holes or other discontinuities such that the sensor cannot establish consistent electrical contact with the wall. Positioning ferrofluids along the tool between the sensor and the formation wall can accommodate the discontinuities in the wall and effectively provide a fluid bridge for electrical contact between the sensor and the wall. In this example, the ferrofluid is used as a conductor. In other applications, the ferrofluid can be used as an insulator to define or control electrical paths.

These illustrative examples are given to introduce the reader to the general subject matter discussed here and are not intended to limit the scope of the disclosed concepts. The following describes various additional aspects and examples with reference to the drawings in which like numerals indicate like elements, and directional descriptions are used to describe the illustrative aspects. The following uses directional descriptions such as "above," "below," "upper," "lower," "upward," and "downward," etc. in relation to the illustrative aspects as they are depicted in the figures, the upward direction being toward the top of the corresponding figure and the downward direction being toward the bottom of the corresponding figure. Like the illustrative aspects, the numerals and directional descriptions included in the following sections should not be used to limit the present disclosure.

Figure 1:
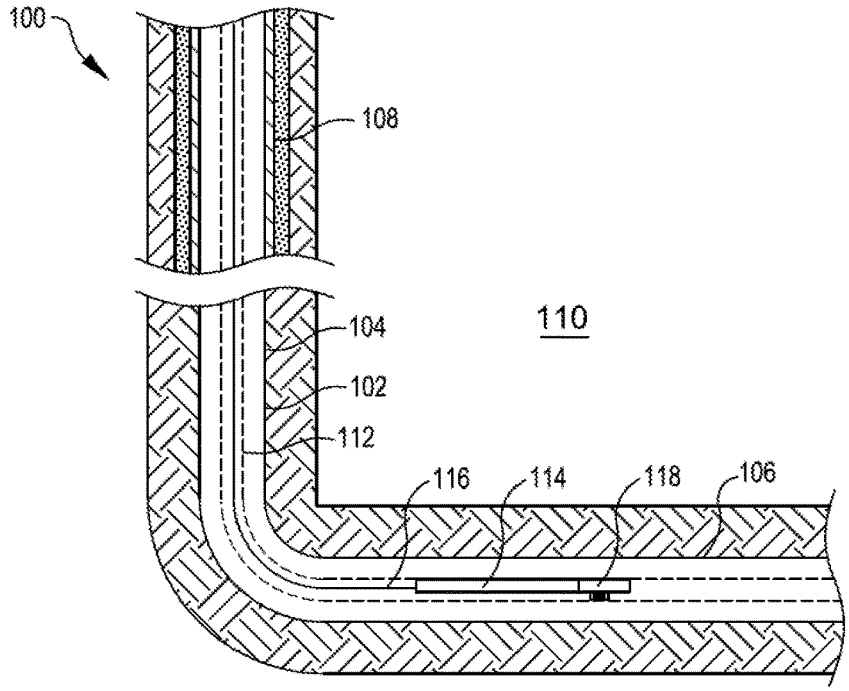
FIG. 1 is a schematic illustration of a well system having a ferrofluid tool according to one aspect of the present disclosure.

FIG. 1 schematically depicts an example of a well system 100 having a ferrofluid tool 118 for controlling one or more electrically conductive paths using ferrofluids. Although the well system 100 is depicted with one ferrofluid tool 118, any number of ferrofluid tools can be used in the well system 100. The well system 100 includes a bore that is a wellbore 102 extending through various earth strata. The wellbore 102 has a substantially vertical section 104 and a substantially horizontal section 106. The substantially vertical section 104 and the substantially horizontal section 106 can include a casing string 108 cemented at an upper portion of the substantially vertical section 104. The substantially horizontal section 106 extends through a hydrocarbon bearing subterranean formation 110.

A tubing 112 string within the wellbore 102 can extend from the surface to the subterranean formation 110. The tubing 112 can provide a conduit for formation fluids, such as production fluids produced from the subterranean formation 110, to travel from the substantially horizontal section 106 to the surface. Pressure from a bore in a subterranean formation 110 can cause formation fluids, including production fluids such as gas or petroleum, to flow to the surface.

The ferrofluid tool 118 can be part of a tool string 114. The ferrofluid tool 118 can be the sole tool in the tool string 114, or the tool string 114 can include other downhole tools (including other ferrofluid tools). The tool string 114 can be deployed into the well system 100 on a wire 116. The tool string 114 can be deployed into the tubing 112 or independent of the tubing 112. In some aspects, the tool string 114 can be deployed as part of the tubing 112 and the wire 116 can be omitted. In other aspects, the tool string 114 can be deployed in a portion of a well system 100 that does not include tubing 112.

Although FIG. 1 depicts the ferrofluid tool 118 in the substantially horizontal section 106, the ferrofluid tool 118 can be located, additionally or alternatively, in the substantially vertical section 104. In some aspects, the ferrofluid tool 118 can be disposed in simpler wellbores, such as wellbores having only a substantially vertical section. In some aspects, the ferrofluid tool 118 can be disposed in more complex wellbores, such as wellbores having portions disposed at various angles and curvatures. The ferrofluid tool 118 can be disposed in openhole environments, as depicted in FIG. 1, or in cased wells.

Figure 2:
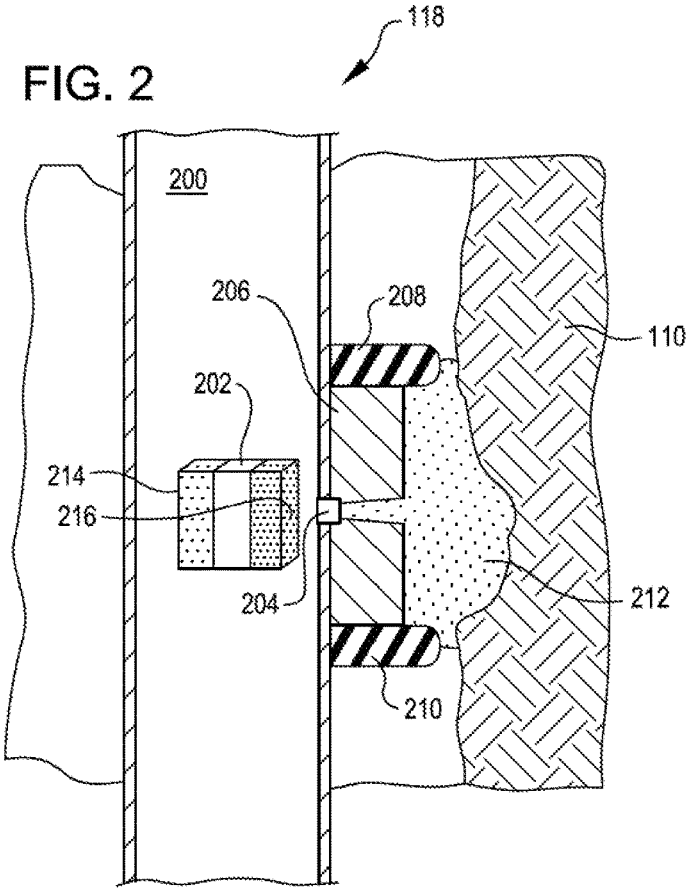
FIG. 2 is a cross-sectional view of an example of a ferrofluid tool according to one aspect of the present disclosure.

FIG. 2 is a cross-sectional view of an example of the ferrofluid tool 118 according to one aspect. The ferrofluid tool 118 can include a tool body 200, a magnet 202, a ferrofluid source 204, a sensor 206, and one or more ferrofluid isolators 208, 210. In some aspects, the ferrofluid source 204, the magnet 202, the sensor 206, or some combination thereof can be controlled by a system control center in communication with the ferrofluid tool 118.

The magnet 202 can be positioned in or connected with the tool body 200. For example, the magnet 202 can be on the tool body 200, directly connected to the tool body 200, or connected with the tool body 200 through intervening components or structure. Non-limiting examples of the magnet 202 include an electromagnet, a permanent magnet, and a device for producing magnetic fields. The ferrofluid source 204 can be positioned in or connected with the tool body 200. The ferrofluid source 204 can be located near the magnet 202. In some aspects, the ferrofluid source 204 can include a nozzle or a port (or both). The sensor 206 can be connected with an exterior of the tool body 200. The first ferrofluid isolator 208 can be positioned to one end of the sensor 206. The second ferrofluid isolator 210 can be positioned on another end of the sensor 206. For example, the first ferrofluid isolator 208 can be positioned above the sensor 206, while the second ferrofluid isolator 210 can be positioned below the sensor 206.

In some aspects, the tool body 200 can be part of a tool string, such as the tool string 114 of FIG. 1. In some aspects, the tool body 200 can be a component distinct from the tool string 114. For example, the tool body 200 can be positioned at the end of an arm extending from the tool string 114 or a mandrel. Positioning the tool body 200 on an arm can provide a close or consistent contact between the sensor 206 on the tool body 200 and a formation 110 to be measured.

The ferrofluid source 204 can introduce ferrofluid 212 into a space between the tool body 200 and the formation 110. The magnet 202 can magnetically couple with the ferrofluid 212. The magnet 202 can exert an external magnetic field upon the ferrofluid 212. The magnetic field exerted on the ferrofluid 212 can cause the ferrofluid 212 to align with the magnetic field. The magnetic field can position the ferrofluid 212 between the tool body 200 and the formation 110. The ferrofluid 212 can have electrically conductive characteristics. The electrically conductive ferrofluid 212 can provide an electrically conductive path that spans between the formation 110 and a portion of the ferrofluid tool 118, such as the sensor 206. Providing the electrically conductive path between the sensor 206 and the formation 110 by the ferrofluid 212 can improve the electrical contact between the sensor 206 and the formation 110. Improved electrical contact between the sensor 206 and the formation 110 can improve the accuracy of the sensor 206 or reduce the amount of energy expended to obtain useable readings.

The magnet 202 can include a first pole 216 and a second pole 214 having opposite polarities. Magnetic particles in the ferrofluid 212 can align with the magnetic field of the magnet 202 such that the ferrofluid 212 can be attracted toward either of poles 214, 216. The attraction toward both poles 214, 216 can cause the ferrofluid 212 to tend to spread out along the face of the tool body 200 to follow the minimum magnetic path length between the two poles 214, 216. In some aspects, the magnet 202 can be placed off-center in the tool body 200 and closer to the ferrofluid source 204. Such placement can shift the minimum magnetic path length between the two poles 214, 216 and reduce the tendency of the ferrofluid 212 to spread out. In some aspects, the ferrofluid isolators 208 and 210 can obstruct the path of the ferrofluid 212 and prevent the ferrofluid 212 from spreading out along the face of the tool body 200. The ferrofluid isolators 208, 210 can retain the ferrofluid 212 in the magnetic field of the magnet 202 in a shape protruding from the face of the tool body 200 defined between the ferrofluid isolators 208, 210. Ferrofluid isolators 208, 210 can be constructed of material having low magnetic permeability. An example of material from which the ferrofluid isolators 208, 210 can be constructed includes rubber. The ferrofluid isolators 208, 210 can be used to guide the ferrofluid 212 from the ferrofluid source 204. For example, the ferrofluid isolators 208, 210 can be positioned respectively above and below the ferrofluid source 204 such that the ferrofluid 212 is retained in a vertical region between the ferrofluid isolators 208, 210.

Figure 3:
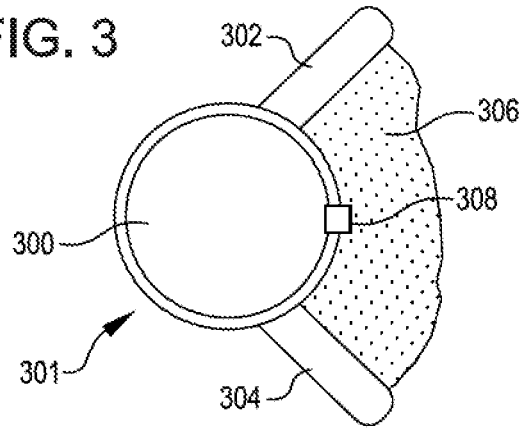
FIG. 3 is a top cross-sectional view of an example of a ferrofluid tool with ferrofluid isolators according to one aspect of the present disclosure.

Although the ferrofluid isolators 208, 210 are depicted in FIG. 2 as positioned above and below the ferrofluid source 204, other arrangements are possible. FIG. 3 is a top cross-sectional view of an example of a ferrofluid tool 301 with ferrofluid isolators 302, 304 according to one aspect. The ferrofluid tool 301 can include a tool body 300, a first ferrofluid isolator 302, a second ferrofluid isolator 304, ferrofluid 306, and a ferrofluid source 308. The first ferrofluid isolator 302 can be positioned laterally in a first direction from the ferrofluid source 308 along the circumference of the tool body 300. The second ferrofluid isolator 304 can be positioned laterally in a second direction from the ferrofluid source 308 along the circumference of the tool body 300. The lateral position of the ferrofluid isolators 302, 304 can limit the circumferential size of the ferrofluid 306 positioned adjacent to the tool body 300. For example, the ferrofluid isolators 302, 304 can be positioned laterally to either side of the ferrofluid source 308 such that the ferrofluid 306 is retained in a lateral region between the ferrofluid isolators 302, 304. In some aspects, the ferrofluid tool 301 has no isolators. In other aspects, the ferrofluid tool 301 has only vertically-positioned isolators or only laterally-positioned isolators or some combination of vertically- and laterally-positioned isolators. For example, the ferrofluid tool 301 can include vertically-positioned ferrofluid isolators (such as the ferrofluid isolators 208, 210 depicted in FIG. 2) in addition to the laterally-positioned ferrofluid isolators 302, 304 depicted in FIG. 3. Any number, shape, or arrangement (or combination thereof), of ferrofluid isolators can be used to retain ferrofluid in a region bounded by a ferrofluid isolator.

Figure 4:
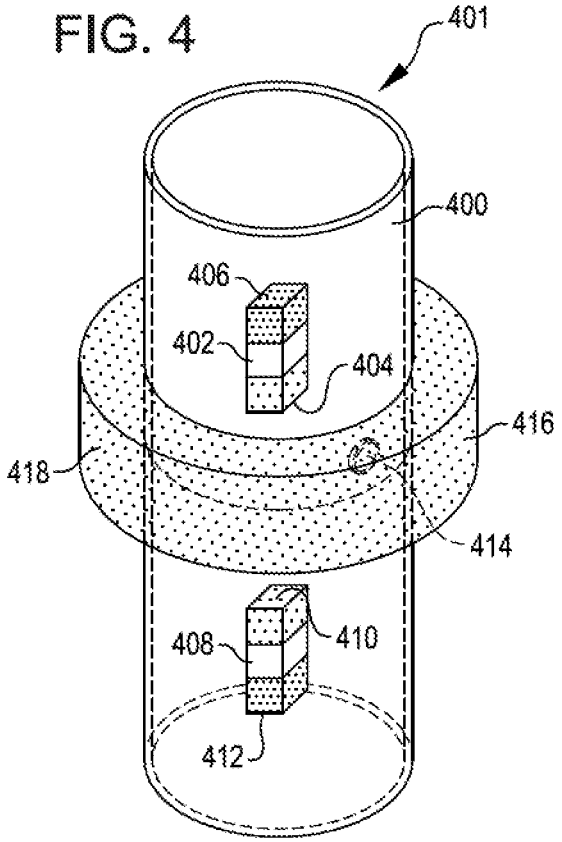
FIG. 4 is a perspective view of an example of a ferrofluid tool with a toroid of ferrofluid according to one aspect of the present disclosure.

Other types of ferrofluid tools can be used alternatively or additionally in the well system 100 depicted in FIG. 1. FIG. 4 is a perspective view of an example of a ferrofluid tool 401 with a toroid of ferrofluid 416 according to one aspect. The ferrofluid tool 401 can include a tool body 400, a first magnet 402, a second magnet 408, and a ferrofluid source 414. Magnets 402, 408 can be arranged such that the first end 404 of the first magnet 402 is facing the first end 410 of the second magnet 408. The first ends 404 and 410 can have the same polarity. The second end 406 of the first magnet 402 can have the same polarity as the second end 412 of the second magnet 408. The magnets 402, 408 can be arranged such that the second ends 406 and 412 are facing away from one another. The magnets 402, 408 can be aligned such that a magnet polarization vector of the first magnet 402 is aligned along the axis of the tool and in an opposite direction to a magnet polarization vector of the second magnet 408. This configuration can provide a magnetic field having a radial pattern in the region between the magnets 402, 408. The radial magnetic field can arrange ferrofluid 416 from the ferrofluid source 414 in an annular ring pattern. In some aspects, the annular ring pattern of the ferrofluid 416 is a radially omnidirectional shape. One example of a radially omnidirectional shape is a toroid. The radially omnidirectional shape can provide radially omnidirectional contact between the tool body 400 and the formation 110.

In some aspects, the ferrofluid 416 can provide contact between the tool body 400 and the formation 110 in fewer than all radial directions. In one example, the ferrofluid 416 can be retained in one quarter (or some other portion) of a radially omnidirectional shape around the tool body 400. The ferrofluid tool 401 can include ferrofluid isolators (such as the ferrofluid isolators 302, 304 depicted in FIG. 3) for retaining the ferrofluid 416 in such a configuration. In some aspects, retaining the ferrofluid within one quarter (or some other portion) of a radially omnidirectional shape can provide contact between the tool body 400 and the formation 110 in that one quarter (or other portion) of all radial directions. In some aspects, such an arrangement can allow wellbore fluids to flow unobstructed by ferrofluid 416 through a different portion of the omnidirectional shape around the tool body 500. For example, the ferrofluid 416 can be retained on a front side of the tool body 400 for controlling an electrically conductive path while wellbore fluids are permitted to flow over a back side of the tool body 400.

In some aspects, the configuration of opposite-facing magnets 402, 408 can be substituted for the magnet 202 in the ferrofluid tool 118 depicted in FIG. 2. This configuration can produce strong radial magnetic flux lines for aligning the ferrofluid 212.

Figure 5:
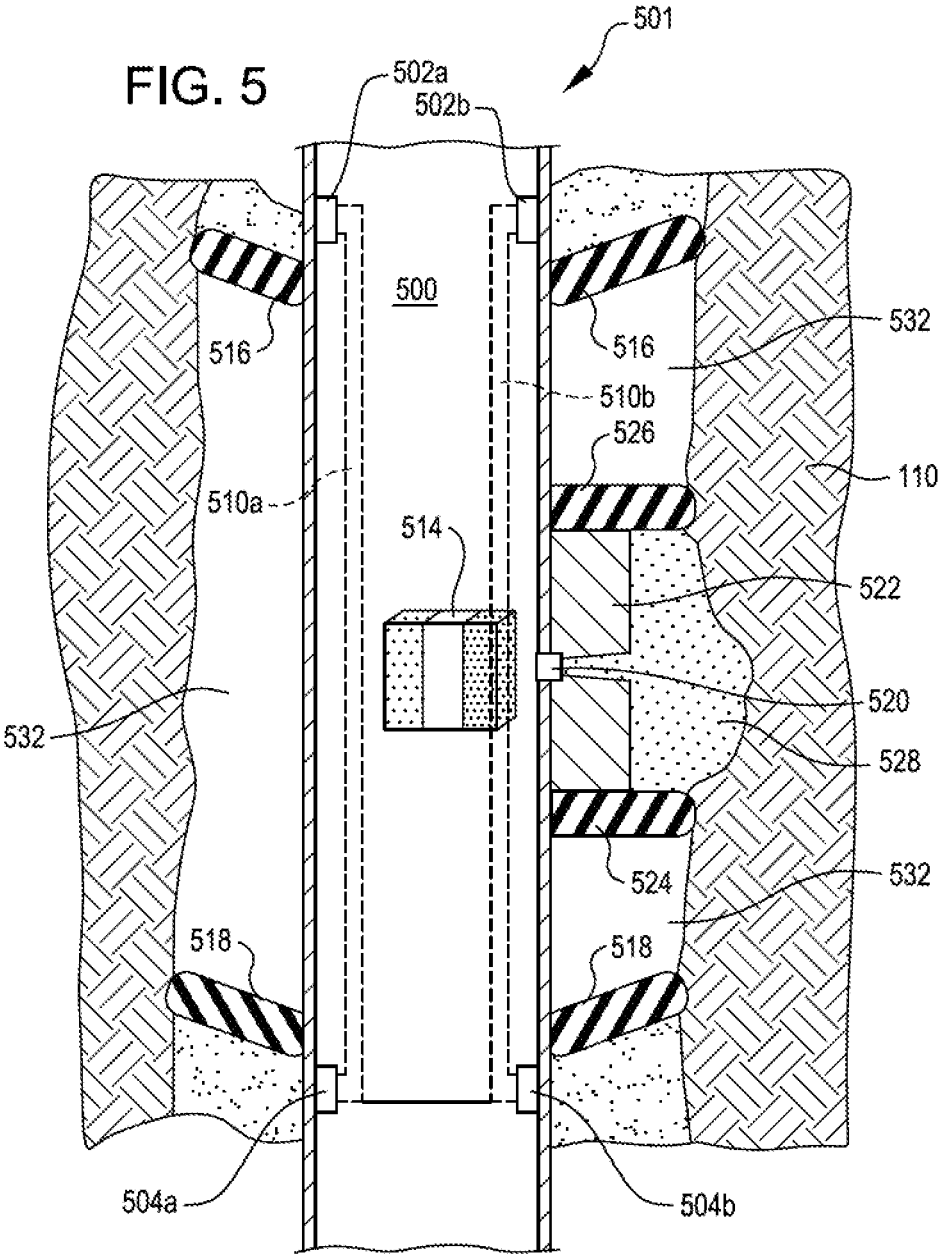
FIG. 5 is a cross-sectional view of an example of a ferrofluid tool having mud baffles and mud-flow passageways according to one aspect of the present disclosure.

FIG. 5 is a cross-sectional view of an example of a ferrofluid tool 501 having mud baffles 516, 518 and mud-flow passageways 510*a*, 510*b* according to one aspect. The ferrofluid tool 501 can include a tool body 500, one or more mud-flow passageways 510, a magnet 514, an upper mud baffle 516, a lower mud baffle 518, a ferrofluid source 520, a sensor 522, and ferrofluid isolators 524, 526. The lower mud baffle 518 can be positioned between the tool body 500 and the formation 110 wall. The lower mud baffle 518 can provide an annular barrier around the tool body 500 to prevent flow of wellbore fluids past the lower mud baffle 518 along an annulus between the tool body 500 and the formation 110. The lower mud baffle 518 can prevent flow of wellbore fluids upward. The upper mud baffle 516 can be positioned to prevent the flow of wellbore fluids downward past the upper mud baffle 516 into an annulus between the tool body 500 and the formation 110. With the mud baffles 516, 518 so configured, wellbore fluids can be at least partially prevented from entering a sheltered region 532 of the annulus defined between the upper mud baffle 516 and the lower mud baffle 518.

The one or more mud-flow passageways 510 can be positioned internal to the tool body 500. Each mud-flow passageway 510 can include a lower opening 504 and an upper opening 502. Each mud-flow passageway 510 can provide a flow path for wellbore fluid to pass between a position below the lower mud baffle 518 and a position above the upper mud baffle 516. For example, the lower mud baffle 518 can divert a flow of wellbore fluid through the lower opening 504*a* of a mud-flow passageway 510*a*. The wellbore fluid can flow through the tool body 500 via the mud-flow passageway 510*a*. Wellbore fluid can exit the mud-flow passageway 510*a* via the upper opening 502*a*. Wellbore fluid exiting the upper opening 502*a* of the mud-flow passageway 510*a* can reenter the annulus above the upper mud baffle 516. Flow of wellbore fluids through the tool body 500 via a mud-flow passageway 510 can reduce an amount of wellbore fluid entering the sheltered region 532 in between the upper mud baffle 516 and the lower mud baffle 518. Reducing the amount of wellbore fluid that can enter the sheltered region 532 between the mud baffles 518, 516 can reduce a flow of wellbore fluids exerted against ferrofluid 528 emitted from the ferrofluid source 520.

Figure 6:
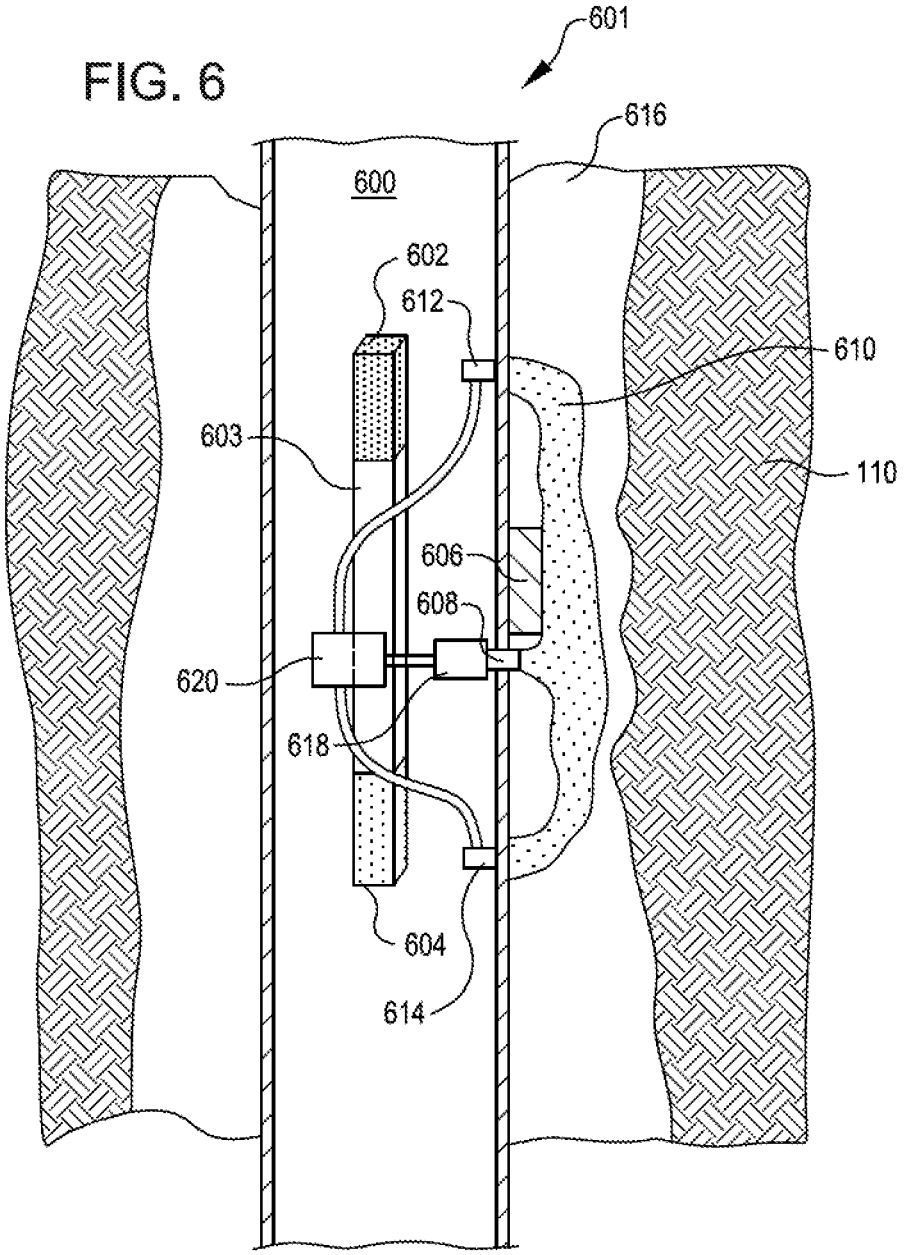
FIG. 6 is a cross-sectional view of an example of a ferrofluid tool with ferrofluid for controlling an electrically conductive path between two points on a tool body according to one aspect of the present disclosure.

FIG. 6 is a cross-sectional view of an example of a ferrofluid tool 601 with ferrofluid 610 for controlling an electrically conductive path between two points on a tool body 600 according to one aspect. The ferrofluid tool 601 can include a tool body 600, a magnet 603, a sensor 606, a ferrofluid source 608, a first collector 612, a second collector 614, a tank 618, and a filter 620.

Ferrofluid 610 can be conveyed from the tank 618 via the ferrofluid source 608. The ferrofluid source 608 can be a port or nozzle or any other structure for conveying ferrofluid 610 into an annulus 616 between the tool body 600 and the formation 110. Ferrofluid 610 in the annulus 616 can be attracted toward a first pole 602 of the magnet 603 and move toward the first pole 602. The ferrofluid 610 moving toward the first pole 602 can provide a conductive path that spans between two points on the tool body 600. An electrically conductive path that spans two points may electrically couple the two points. For example, the ferrofluid 610 can provide a conductive path from the sensor 606 positioned in the path of the ferrofluid 610 to another portion of the tool body 600, such as a point adjacent to the first collector 612.

The ferrofluid 610 can be attracted in another direction toward the second pole 604 of the magnet 603 and flow toward the second pole 604. Flow of the ferrofluid 610 toward the second pole 604 can provide a conductive path between points on the tool body 600 such as from a point near the second collector 614 to a point near the first collector 612 depicted in FIG. 6. Although the ferrofluid 610 is depicted in FIG. 6 as arranged without contacting the formation 110, in some aspects the ferrofluid 610 can be arranged to contact the formation, such as to provide a conductive path between the one or multiple points on the formation and one or multiple points one the tool body 600.

Collectors 612 and 614 can be positioned in the path of ferrofluid 610. For example, collectors 612, 614 can be positioned near poles 602, 604. Positioning collectors 612, 614 near poles 602, 604 can draw ferrofluid 610 toward the collectors 612, 614. Collectors 612, 614 can collect ferrofluid 610 from the annulus 616. In some aspects, the collectors 612, 614 can include nozzles or ports (or both). Ferrofluid 610 collected by one or more collectors 612, 614 can be conveyed to the filter 620. The filter 620 can separate ferrofluid 610 from wellbore fluids conveyed with ferrofluid 610 via one or more collectors 612, 614. The ferrofluid 610 collected by the collector 612 or 614 or both can be conveyed to the tank 618. Collecting ferrofluid 610 from the annulus 616 and conveying it to the tank 618 can conserve ferrofluid 610 used in operation of the ferrofluid tool 601.

Although the ferrofluid tool 601 is depicted in FIG. 6 as having one magnet 603 and two collectors 612, 614, other arrangements are possible. For example, the ferrofluid tool 601 can include only one collector. In other aspects, the ferrofluid tool 601 can include two or more magnets or three or more collectors (or both). Additionally, in some aspects, a single magnet can be used to attract ferrofluid 610 to more than one collector. In other aspects, two or more magnets can be used to attract the ferrofluid 610 to a particular collector. Although ferrofluid tool 601 is depicted in FIG. 6 without ferrofluid isolators, in some aspects, ferrofluid tool 601 can use ferrofluid isolators, such as, but not limited to, ferrofluid isolators 402 or 404. Furthermore, although other figures do not show collectors 612, 614, filters 620, or tanks 618, such elements can also be used with other aspects disclosed herein.

Figure 7:
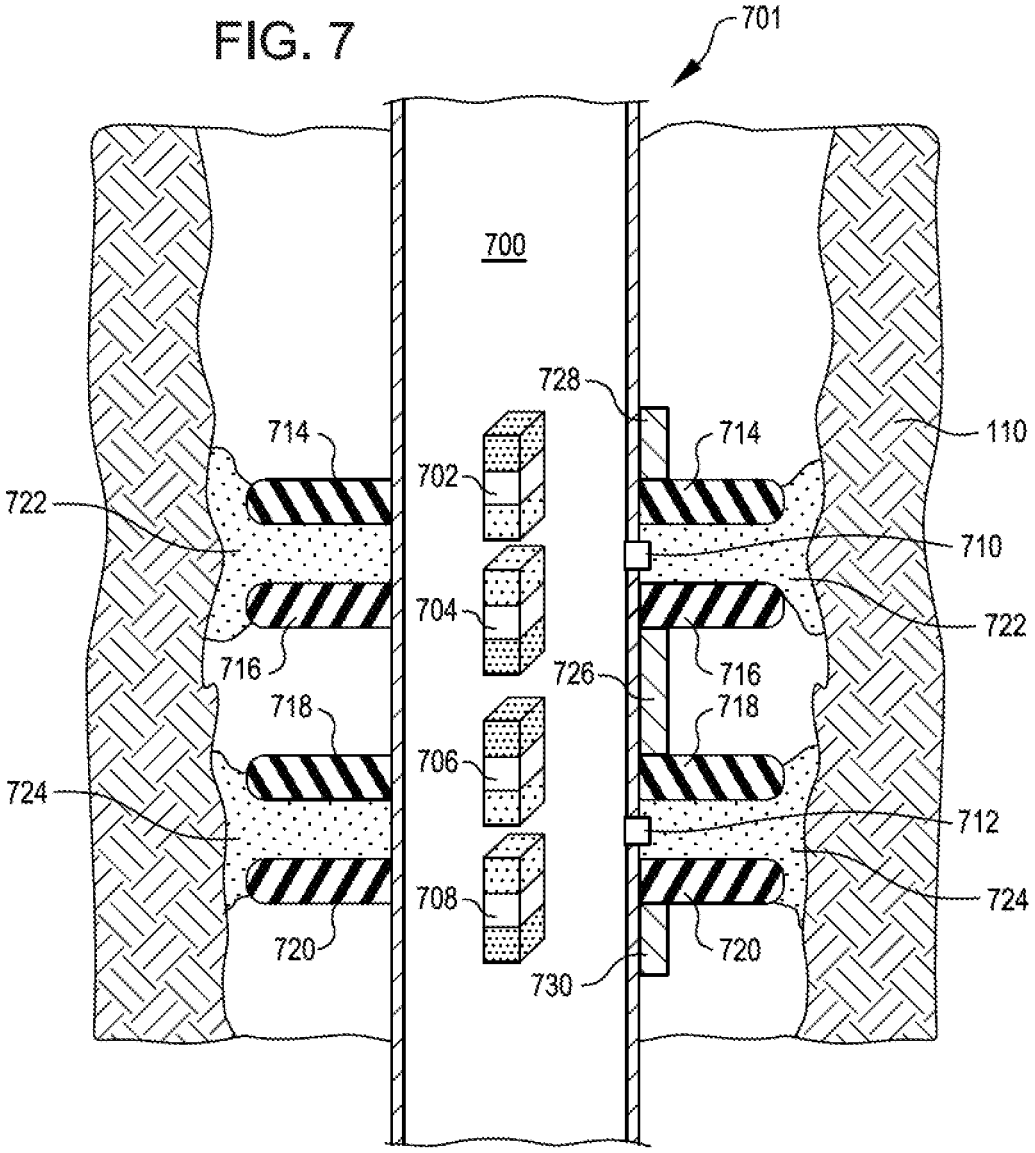
FIG. 7 is a cross-sectional view of an example of a ferrofluid tool with ferrofluid for isolating an electrically conductive path according to one aspect of the present disclosure.

FIG. 7 is a cross-sectional view of an example of a ferrofluid tool 701 with ferrofluid 722, 724 for isolating an electrically conductive path according to one aspect. The ferrofluid tool 701 can include a tool body 700, an excitation electrode 726, and return electrodes 728 and 730. The ferrofluid tool 701 can also include features discussed above with regard to prior figures, such as magnets 702, 704, 706, 708; ferrofluid sources 710 and 712; ferrofluid isolators 714, 716, 718 and 720; and ferrofluid 722 and 724.

A first mass of ferrofluid 722 can be positioned about the tool body 700 at a first position using magnets 702, 704, ferrofluid isolators 714, 716, and a ferrofluid source 710. A second mass of ferrofluid 724 can be positioned about a second position of the tool body 700 using magnets 706, 708, a ferrofluid source 712, and ferrofluid isolators 718, 720. The ferrofluid 722, 724 can have electrically resistive properties. The mass of ferrofluid 722 with electrically resistive properties can provide an electrically resistive path. The electrically resistive path can include an insulating or resistive boundary between the excitation electrode 726 and the return electrode 728. The mass of ferrofluid 724 with electrically resistive properties can provide an insulating or resistive boundary between the excitation electrode 726 and the return electrode 730. Providing a resistive boundary between the excitation electrode 726 and either or both of the return electrodes 728, 730 can reduce an amount of current that would otherwise travel directly between the excitation electrode 726 and the return electrodes 728, 730 through the wellbore fluid in the annulus between the tool body 700 and the formation 110. Current can instead be directed into the formation 110 along the electrically conductive path positioned and controlled between boundaries of resistive ferrofluids 722, 724. Positioning an electrically conductive path between resistive ferrofluids 722, 724 can focus transmitted current into the formation 110 and reduce the amount of current travelling through the borehole. Transmitting a greater amount of current through the formation 110 rather than through the borehole can increase the accuracy of information obtained about the formation 110 resistivity by the electrode tool or sensor.

Although the ferrofluid tool 701 is depicted in FIG. 7 with a first mass of ferrofluid 722 and a second mass of ferrofluid 724, other arrangements are possible. In some aspects, a third mass of ferrofluid can be positioned between the first mass of ferrofluid 722 and the second mass of ferrofluid 724 by magnets 704 and 706. In one example, a third mass of conductive ferrofluid so positioned can improve current flow from the excitation electrode 726 to the formation 110 along the electrically conductive path defined between the resistive ferrofluids 722, 724. Additionally, such a configuration with four magnets radially positioning three masses of ferrofluid illustrates that a number N of ferrofluid masses can be positioned by a number N+1 of magnets arranged with like poles facing one another. The number N of ferrofluid masses can use any combination of conductive or resistive ferrofluids. Multiple ferrofluid masses can be implemented in various aspects described herein.

Although the ferrofluid tool 701 is depicted in FIG. 7 with features such as a plurality of ferrofluid isolators 714, 716, 718, 720, other arrangements are possible. For example, the ferrofluid tool 701 can omit or include any combination of the ferrofluid isolators 714, 716, 718, 720 or use other orientations of one or more of the ferrofluid isolators 714, 716, 718, 720. Additionally, although the ferrofluid tool 701 is depicted in FIG. 7 with features such as oppositely-facing magnets 702, 704, 706, 708, other arrangements are possible. For example, the ferrofluid tool 701 can omit or include any combination of magnets 702, 704, 706, 708, or use other orientations of one or more of the magnets 702, 704, 706, 708.

Although various aspects are described above as relative to the formation 110, other arrangements are possible. Aspects can be implemented in open-hole environments or cased-hole environments (or both). For example, aspects described above can be implemented when tubing or casing exists in the place of the subterranean formation 110. In one example, the ferrofluid 212 of the ferrofluid tool 118 depicted in FIG. 2 can provide an electrically conductive path spanning between a portion of the ferrofluid tool 118 and a casing 108 (rather than a formation 110). In this and other aspects, a ferrofluid tool 118 can control an electrically conductive path, such as in an annulus between the ferrofluid tool 118 and a tubular element or a formation, even when the tool string 114 is moving.

Figure 8:
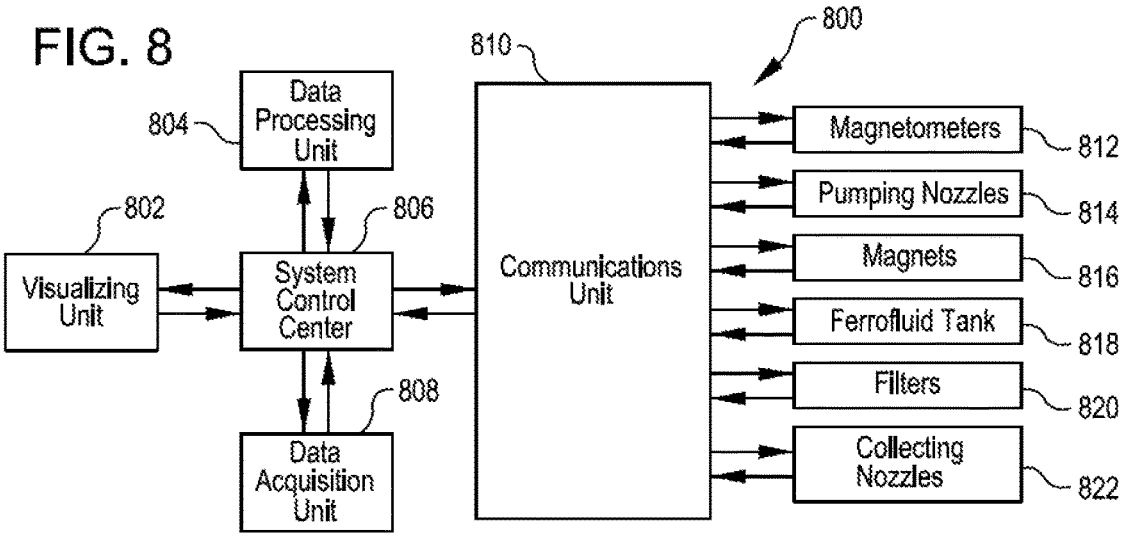
FIG. 8 is a block diagram depicting an example of a system for using ferrofluid to control electrically conductive paths according to one aspect of the present disclosure.

FIG. 8 is a block diagram depicting an example of a system 800 for using ferrofluid to control electrically conductive paths according to one aspect. The system 800 can include a system control center 806, a visualizing unit 802, a data processing unit 804, a data acquisition unit 808, a communications unit 810, magnetometers 812, pumping nozzles (or other ferrofluid sources) 814, magnets 816, ferrofluid tank 818, filters 820, and collecting nozzles (or other ferrofluid collectors) 822. System 800 can include more or fewer than all of these listed components.

The system control center 806 can control the operation of the system 800 for controlling electrically conductive paths in an annulus between a wellbore formation and a tool positioned in the wellbore. The system control center 806 can include a processor device and a non-transitory computer-readable medium on which machine-readable instructions can be stored. Examples of non-transitory computer-readable medium include random access memory (RAM) and read-only memory (ROM). The processor device can execute the instructions to perform various actions, some of which are described herein. The actions can include, for example, communicating with other components of the system 800.

The system control center 806 can communicate via the communications unit 810. For example, the system control center 806 can send commands to initiate the pumping nozzles 814 via the communications unit 810. The communications unit 810 can also communicate information about components to the system control center 806. For example, the communications unit 810 can communicate a status of the pumping nozzle 814, such as pumping or not, to the system control center 806.

The system control center 806 can receive information via communications unit 810 from magnetometers 812. Magnetometers 812 can be configured to detect a presence of ferrofluids in the annulus. For example, the magnetometers 812 can detect a level of ferrofluid introduced into the annulus by the ferrofluid source or pumping nozzle 814. The magnetometer 812 can also detect a level of ferrofluid at a position away from the pumping nozzle 814 to detect a level of ferrofluid that has escaped from the magnetic field of magnets 816. The system control center 806 can also communicate via the communications unit 810 with the magnetometers 812. For example, the system control center 806 can send instructions for the magnetometers 812 to initiate or terminate detection.

The system control center 806 can also communicate via the communications unit 810 with the magnets 816. For example, the system control center 806 can send instructions to initiate or terminate magnetic fields provided by the magnet 816. For example, the magnet 816 can be an electromagnet and the system control center 806 can provide instructions regarding whether to provide current to the electromagnet to cause the electromagnet to produce a magnetic field. The system control center 806 can also communicate with the magnets 816 to provide instructions to move the magnets 816 or to adjust the magnetic field produced by the magnets 816. Movement of the magnets 816 or the magnetic field produced by the magnets 816 can provide additional control over ferrofluids positioned in the wellbore. Additional control over the ferrofluids and the wellbore can provide additional control over electrically conductive paths positioned in the wellbore. The magnet 816 can also communicate with the system control center 806 via the communications unit 810, such as regarding the strength of the magnetic field the magnet 816 is producing.

The system control center 806 can also communicate via the communications unit 810 with the collecting nozzles 822. For example, the system control center 806 can send instructions to the collecting nozzles 822 to initiate collection of ferrofluids from the wellbore. The system control center 806 can initiate the collecting nozzles 822 based on information received from the magnetometers 812, or the pumping nozzles 814, or the magnets 816 or any combination thereof. The communications unit 810 can also communicate information about the collecting nozzles 822 to the system control center 806. For example, the communications unit 810 can communicate a status of the collecting nozzle 822, such as pumping or not, or how much ferrofluid is being collected by the collecting nozzle 822.

The system control center 806 can also communicate via the communications unit 810 with the ferrofluid tank 818. For example, the system control center 806 can receive information from the ferrofluid tank 818 regarding the status of the ferrofluid tank 818, such as how full the ferrofluid tank 818 is. The system control center 806 can also initiate or terminate collection by the collecting nozzles 822 based on the information received from the ferrofluid tank 818. The system control center 806 can provide instructions to the ferrofluid tank 818 to initiate filling of the ferrofluid tank 818 from another source distinct from the collecting nozzles 822, such as from a line for refilling the ferrofluid tank 818 from the surface.

One or more filters 820 can be provided to separate ferrofluid from wellbore fluid in the fluid that has been collected by collecting nozzles 822. The filter 820 can convey collected ferrofluid into the ferrofluid tank 818. The system control center 806 can also communicate with the filter 820 via communications unit 810. For example, the system control center 806 can send instructions to the filter 820 regarding whether the filter 820 is to perform its filtering function based on the information received by the magnetometers 812, the collecting nozzles 822, etc. The communications unit 810 can also communicate information about the filters 820 to the system control center 806. For example, the communications unit 810 can communicate a status of the filters 820 (such as filtering or not), how much ferrofluid is being filtered by the filters 820, or whether the filters 820 need to be changed or not.

The system control center 806 can also be in communication with a data acquisition unit 808. The data acquisition unit 808 can acquire data from any of the units depicted in FIG. 8 or any other sensors that are included in the system 800.

The system control center 806 can also be in communication with a data processing unit 804. The data processing unit 804 can include a processor device and a non-transitory computer-readable medium on which machine-readable instructions can be stored. The processor device can execute the instructions to perform various actions, some of which are described herein. As a non-limiting example, the data processing unit 804 can process data acquired by the data acquisition unit 808. For example, the data processing unit 804 can provide information based on acquired data that is used for determining whether to activate pumping nozzles 814, operate magnets 816, or operate collecting nozzles 822, or any combination thereof.

The system control center 806 can also be in communication with a visualizing unit 802. The visualizing unit 802 can provide an interface for an operator of the system to check system operation and input intervening commands if necessary. Such intervening commands can override default or preset conditions earlier entered or used by the system control center 806.

Visualizing unit 802, data processing unit 804, system control center 806, data acquisition unit 808, and communications unit 810 can be positioned or located at the surface of a well system 100. Alternatively, one or multiple of these components can also be located in a tool positioned within a wellbore rather than at the surface.

Figure 9:
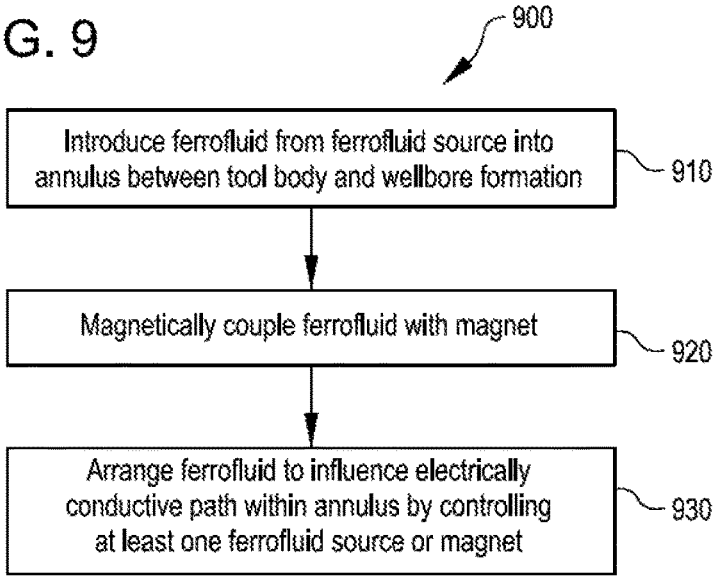
FIG. 9 is a flow chart illustrating an example method for influencing or controlling electrically conductive paths using ferrofluids in a wellbore according to one aspect of the present disclosure.

FIG. 9 is a flow chart illustrating an example method 900 for influencing or controlling electrically conductive paths using ferrofluids in a wellbore according to one aspect of the present disclosure. The method can include introducing ferrofluid from a ferrofluid source into an annulus, as shown in block 910. The ferrofluid source can be part of a downhole assembly having a tool body, the ferrofluid source, and a magnet. The annulus can be defined between the tool body and a wellbore formation. For example, a ferrofluid tool such as ferrofluid tool 118 (described above with respect to FIGS. 1-2) can be utilized in the method 900.

The method can include magnetically coupling the ferrofluid with the magnet, as shown in block 920. The method can include arranging the ferrofluid to control or influence an electrically conductive path within the annulus by controlling at least one of the ferrofluid source or the magnet, as shown in block 930.

A ferrofluid can be a substance in which ferromagnetic particles are suspended in a carrier liquid. A ferrofluid can be a solution in which ferromagnetic particles are a solute dissolved in a carrier liquid solvent. The ferromagnetic particles in a ferrofluid can move freely inside the carrier liquid without settling out of the carrier liquid. The ferromagnetic particles inside a ferrofluid can be randomly distributed in the absence of an external magnetic field such that there is no net magnetization. Applying an external magnetic field to a ferrofluid can cause magnetic moments of the ferromagnetic particles to align with the external magnetic field to create a net magnetization. A shape or position (or both) of a ferrofluid may be controlled by changing a strength or a gradient (or both) of an external magnetic field applied to the ferrofluid.

Surfactants can be used in manufacturing ferrofluids. Surfactants can prevent ferromagnetic particles from adhering together, which can otherwise cause the ferromagnetic particles to form heavier clusters that could precipitate out of the solution.

Many different combinations of ferromagnetic particle, surfactant, and carrier fluid can be utilized to produce a ferrofluid. The variety of combinations can provide extensive opportunities to optimize the properties of a ferrofluid to a particular application. In one example, appropriate selection of the materials composing a ferrofluid can provide a ferrofluid that is more electrically conductive or more electrically resistive in accordance with the goals of a particular application.

Examples of ferromagnetic particles that can be used in ferrofluids include cobalt, iron, and iron-cobalt compounds (such as magnetite). A ferrofluid can use ferromagnetic particles of a single kind, a single composition, or a variety of kinds or compositions. Dimensions of the ferromagnetic particles in a ferrofluid can be small, e.g., in the order of nanometers (nm). In one example, a ferrofluid can have an average ferromagnetic particle size of 10 nm.

Examples of surfactants that can be used in ferrofluids include cis-oleic acid, tetramethylammonium hydroxide, citric acid, and soy-lecithin. In some applications, the type of surfactant used can be a determining factor in the useful life of a ferrofluid. In various applications, a ferrofluid can be a stable substance that can be reliably used for several years before the surfactants lose effectiveness.

Examples of carrier fluids include water-based fluids and oil-based fluids. In one example, a ratio by weight in a ferrofluid can be 5% ferromagnetic particles, 10% surfactants, and 85% carrier liquid.

In some aspects, a downhole system, a tool, or a method is provided for influencing or controlling electrically conductive paths using ferrofluids according to one or more of the following examples.

EXAMPLE #1

A downhole system can include a tool body, a source of ferrofluid, and at least one magnet. The source of ferrofluid can be coupled with or in the tool body. The at least one magnet can produce a magnetic field. The magnetic field can arrange the ferrofluid from the source in an annulus between the tool body and a wellbore formation. The magnetic field can arrange the ferrofluid to influence or control an electrically conductive path in the annulus between the tool body and a wellbore formation field.

EXAMPLE #2

The downhole system of Example #1 may feature at least two magnets positioned such that the magnetic field arranges the ferrofluid from the source in a radially omnidirectional shape about an exterior portion of the tool body.

EXAMPLE #3

The downhole system of any of Examples #1-2 may feature at least two ferrofluid isolators positioned along a face of the tool body. The at least two ferrofluid isolators can be positioned such that the ferrofluid is retained in the magnetic field in a shape protruding from the face of the tool body. The at least two ferrofluid isolators can be positioned such that the ferrofluid is retained between the at least two ferrofluid isolators.

EXAMPLE #4

The downhole system of any of Examples #1-3 may feature a first baffle, a second baffle, and a passageway. The first baffle may be positioned at a first end of the tool body. The second baffle may be positioned at a second end of the tool body. The first baffle and the second baffle may be positioned to divert flow of wellbore fluid away from a sheltered region in the annulus. The sheltered region may be positioned adjacent to the tool body. The sheltered region may be defined between the first baffle and the second baffle. The passageway may be positioned internal to the tool body. The passageway may provide a flow path for wellbore fluid diverted by the first baffle and the second baffle to flow between the first end and the second end of the tool body. The electrically conductive path may be positioned within the sheltered region of the annulus.

EXAMPLE #5

The downhole system of any of Examples #1-4 may feature a ferrofluid collector. The ferrofluid collector may be positioned to collect ferrofluid in the annulus. The ferrofluid collector may collect ferrofluid in the annulus. The ferrofluid collector may convey the collected ferrofluid to the source of the ferrofluid.

EXAMPLE #6

The downhole system of any of Examples #1-5 may feature a ferrofluid source that may be positioned for influencing or controlling an electrically conductive path within the annulus by controlling a flow of the ferrofluid into the magnetic field.

EXAMPLE #7

The downhole system of any of Examples #1-6 may feature a system control center. The system control center may be in communication with at least one of the source of ferrofluid or the magnet. The system control center can arrange the ferrofluid. The system control center may control the source of ferrofluid or the magnet in arranging the ferrofluid. The system control center may influence or control the electrically conductive path within the annulus by at least one of providing commands to the source of ferrofluid to introduce ferrofluid or providing commands to the magnet to produce the magnetic field.

EXAMPLE #8

A downhole system can include a tool body, at least one magnet, and a source of ferrofluid. The magnet can produce a magnetic field in an annulus between the tool body and a wellbore formation. The source of ferrofluid can be positioned for controlling or influencing an electrically conductive path within the annulus by controlling a flow of the ferrofluid into the magnetic field.

EXAMPLE #9

The downhole system of any of Examples #1-8 may feature at least two magnets positioned such that the magnetic field arranges the ferrofluid from the ferrofluid source in a first portion of a radially omnidirectional shape about an exterior portion of the tool body. The ferrofluid can be arranged such that a flow of wellbore fluids is unobstructed by ferrofluid in a second portion of the radially omnidirectional shape.

EXAMPLE #10

The downhole system of any of Examples #1-9 may feature a ferrofluid source that includes a tank and a nozzle. The nozzle can be positioned to convey a flow of ferrofluid from the ferrofluid tank to the annulus. The downhole system may also feature a ferrofluid collector. The ferrofluid collector may be positioned to collect ferrofluid in the annulus from the ferrofluid source. The ferrofluid collector may be positioned to convey the collected ferrofluid to the ferrofluid tank. The downhole system may also feature a ferrofluid filter. The ferrofluid filter may be positioned in communication with the ferrofluid collector. The ferrofluid filter may be positioned such that the ferrofluid filter may reduce wellbore fluids conveyed to the ferrofluid tank by the ferrofluid collector.

EXAMPLE #11

The downhole system of any of Examples #1-10 may feature an upper ferrofluid isolator and a lower ferrofluid isolator. The upper ferrofluid isolator may be positioned along a face of the tool body. The upper ferrofluid isolator may be positioned above the source of ferrofluid. The lower ferrofluid isolator may be positioned along a face of the tool body. The lower ferrofluid isolator may be positioned below the source of ferrofluid. The upper ferrofluid isolator and the lower ferrofluid isolator may be positioned such that the ferrofluid may be retained between the upper ferrofluid isolator and the lower ferrofluid isolator. The upper ferrofluid isolator and the lower ferrofluid isolator may be positioned such that the ferrofluid may be retained in a vertical region along the face of the tool body.

EXAMPLE #12

The downhole system of any of Examples #1-11 may feature a first ferrofluid isolator and a second ferrofluid isolator. The first ferrofluid isolator may be positioned laterally in a first direction from the ferrofluid source along a circumference of the tool body. The second ferrofluid isolator may be positioned laterally in a second direction from the ferrofluid source along a circumference of the tool body. The first ferrofluid isolator and the second ferrofluid isolator may be positioned such that the ferrofluid may be substantially retained in a lateral region along the face of the tool body. The first ferrofluid isolator and the second ferrofluid isolator may be positioned such that the ferrofluid may be substantially retained in between the first ferrofluid isolator and the second ferrofluid isolator.

EXAMPLE #13

The downhole system of any of Examples #1-12 may feature a system control center programmed with instructions to control or for controlling at least one of the source of ferrofluid or the magnet in arranging the ferrofluid. The system control center may arrange the ferrofluid to control or for controlling the electrically conductive path within the annulus by at least one of providing commands to the ferrofluid source or providing commands to the magnet. The system control center may provide commands to the ferrofluid source to control the flow of ferrofluid. The system control center may provide commands to the magnet to produce the magnetic field. The magnet may provide or produce a magnetic field that controls or influences an electrically conductive path within the annulus by arranging the ferrofluid from the ferrofluid source in the annulus.

EXAMPLE #14

A system may include a source of ferrofluid, a magnet, and a system control center. The ferrofluid source may be positioned to introduce or for introducing the ferrofluid into the annulus. The magnet may be positioned to produce or for producing a magnetic field. The magnetic field may arrange in the annulus the ferrofluid introduced by the ferrofluid source. The system control center may be in communication with at least one of the source of ferrofluid or the magnet. The system control center can arrange the ferrofluid. The system control center may control the source of ferrofluid or the magnet in arranging the ferrofluid. The system control center can be programmed with instructions to arrange the ferrofluid in the annulus to control an electrically conductive path within the annulus. The system control center may arrange the ferrofluid or control the electrically conductive path within the annulus by at least one of providing commands to the ferrofluid source or providing commands to the magnet. The system control center may provide commands to the ferrofluid source to introduce the ferrofluid. The system control center may provide commands to the magnet to produce the magnetic field.

EXAMPLE #15

The system of any of Examples #7, 13, or 14 may feature a magnetometer. The magnetometer may be positioned to detect a level of ferrofluid from the ferrofluid source in the annulus. The system control center may be programmed with instructions to arrange the ferrofluid to control the electrically conductive path at least in part based on the level detected by the magnetometer.

EXAMPLE #16

The system of any of Examples #7, 13, 14, or 15 may feature a ferrofluid collector. The ferrofluid collector may be positioned to collect ferrofluid from the ferrofluid source in the annulus. The system control center can be communicatively coupled to the magnet. The system control center can be programmed with instructions to control or for controlling the magnet in arranging the ferrofluid. The system control center may provide commands to the magnet to adjust the magnetic field such that the ferrofluid from the ferrofluid source in the annulus is directed toward the ferrofluid collector. The system control center can adjust the magnetic field such that the ferrofluid from the ferrofluid source in the annulus is directed toward the ferrofluid collector.

In some aspects, a tool or a system, such as a system described in any of the forgoing examples, can be utilized to perform a method according to the following additional examples.

EXAMPLE #17

A method can include introducing, by a downhole assembly having a tool body, a ferrofluid source, and a magnet, ferrofluid from the ferrofluid source into an annulus between the tool body and a wellbore formation. The method can include magnetically coupling the ferrofluid with the magnet. The method can include arranging the ferrofluid to control or influence an electrically conductive path within the annulus by controlling at least one of the ferrofluid source or the magnet.

EXAMPLE #18

The method of example #17 can include arranging the ferrofluid from the ferrofluid source to cause the ferrofluid to provide an electrically conductive path.

EXAMPLE #19

The method of example #17 can include arranging the ferrofluid from the ferrofluid source to cause the ferrofluid to provide an electrically resistive path as a boundary for the electrically conductive path.

EXAMPLE #20

The method of any of Examples #17-19 can include arranging the ferrofluid from the ferrofluid source to cause the electrically conductive path to span between the tool body and the wellbore formation.

EXAMPLE #21

The method of any of Examples #17-20 can include arranging the ferrofluid from the ferrofluid source to cause the electrically conductive path to span between a portion of the tool body and another portion of the tool body.

The foregoing description of the aspects, including illustrated examples, of the disclosure has been presented only for the purpose of illustration and description and is not intended to be exhaustive or to limit the disclosure to the precise forms disclosed. Numerous modifications, adaptations, and uses thereof will be apparent to those skilled in the art without departing from the scope of this disclosure.

What is claimed is:

1. A downhole logging system, comprising:

a tool body for making resistivity measurements;

a source of ferrofluid coupled with or in the tool body;

at least one magnet producing a magnetic field in an annulus to arrange the ferrofluid from the source in the annulus to influence an electrically conductive path within the annulus between the tool body and a wellbore formation;

a baffle positioned to divert flow of wellbore fluid away from a sheltered region in the annulus and into the tool body, the sheltered region being positioned adjacent to the tool body wherein the electrically conductive path is positioned within the sheltered region; and a ferrofluid isolator positioned on the tool body for retaining the ferrofluid in a region bounded at least in part by the ferrofluid isolator while obtaining resistivity readings.

2. The downhole system of claim 1, wherein the at least one magnet includes at least two magnets positioned such that the magnetic field arranges the ferrofluid from the source in a radially omnidirectional shape about an exterior portion of the tool body.

3. The downhole system of claim 1 wherein the ferrofluid isolator comprises at least two ferrofluid isolators positioned along the face of the tool body such that the ferrofluid is retained in the magnetic field in a shape protruding from the face between the at least two ferrofluid isolators.

4. The downhole system of claims 1, wherein the baffle further comprises:

a first baffle positioned at a first end of the tool body; and a second baffle positioned at a second end of the tool body, the sheltered region being defined between the first baffle and the second baffle;

wherein a passageway is positioned internal to the tool body and providing a flow path for wellbore fluid diverted by the first baffle and the second baffle to flow between the first end and the second end of the tool body, and the electrically conductive path is positioned within the sheltered region of the annulus.

5. The downhole system of claim 1, further comprising a ferrofluid collector positioned to collect ferrofluid in the annulus and convey the ferrofluid to the source of the ferrofluid.

6. The downhole system of claim 1, wherein the source is positioned to influence an electrically conductive path within the annulus by controlling a flow of the ferrofluid into the magnetic field.

7. The downhole system of claim 6, further comprising a system control center programmed with instructions to control the source of ferrofluid or the magnet in arranging the ferrofluid to influence the electrically conductive path within the annulus by at least one of providing commands to the source to introduce ferrofluid or providing commands to the magnet to produce the magnetic field.

8. A downhole logging system comprising:

a tool body for making resistivity measurements;

at least one magnet producing a magnetic field in an annulus between the tool body and a wellbore formation;

a source of ferrofluid, the source positioned to influence an electrically conductive path within the annulus by controlling a flow of the ferrofluid into the magnetic field;

a baffle positioned to divert flow of wellbore fluid away from a sheltered region in the annulus and into the tool body, the sheltered region being positioned adjacent to the tool body wherein the electrically conductive path is positioned within the sheltered region; and a ferrofluid isolator positioned on the tool body for retaining the ferrofluid in a region bounded at least in part by the ferrofluid isolator while obtaining resistivity readings.

9. The downhole system of claim 8, wherein the at least one magnet includes at least two magnets positioned such that the magnetic field arranges the ferrofluid from the source in a first portion of a radially omnidirectional shape about an exterior portion of the tool body, wherein a flow of wellbore fluids is unobstructed by ferrofluid in a second portion of the radially omnidirectional shape.

10. The downhole system of claim 8, wherein the source comprises a ferrofluid tank and a nozzle positioned to convey a flow of ferrofluid from the ferrofluid tank to the annulus, wherein the downhole system further comprises:

a ferrofluid collector positioned to collect ferrofluid in the annulus from the source and to convey the collected ferrofluid to the ferrofluid tank; and a ferrofluid filter positioned in communication with the ferrofluid collector such that the ferrofluid filter reduces wellbore fluids conveyed to the ferrofluid tank by the ferrofluid collector.

11. The downhole system of claim 8, wherein the ferrofluid isolator comprises:

an upper ferrofluid isolator positioned along a face of the tool body and above the source of ferrofluid;

a lower ferrofluid isolator positioned along the face of the tool body and below the source of ferrofluid such that the ferrofluid is retained in a vertical region along the face of the tool body between the upper ferrofluid isolator and the lower ferrofluid isolator.

12. The downhole system of claim 8, wherein the ferrofluid isolator comprises:

a first ferrofluid isolator positioned laterally in a first direction from the ferrofluid source along a circumference of the tool body;

a second ferrofluid isolator positioned laterally in a second direction from the ferrofluid source along a circumference of the tool body such that the ferrofluid is retained in a lateral region along a face of the tool body between the first ferrofluid isolator and the second ferrofluid isolator.

13. The downhole system of claim 8, further comprising a system control center programmed with instructions to control at least one of the source of ferrofluid or the magnet in arranging the ferrofluid to influence the electrically conductive path within the annulus by at least one of providing commands to the source to control the flow of ferrofluid or providing commands to the magnet to produce the magnetic field, wherein the magnet produces a magnetic field that influences an electrically conductive path within the annulus by arranging the ferrofluid from the source in the annulus.

14. A logging system comprising:

a tool body for making resistivity measurements;

a ferrofluid source positioned to introduce ferrofluid into an annulus between the tool body and a wellbore formation;

a magnet positioned to produce a magnetic field that arranges, in the annulus, the ferrofluid introduced by the source;

a baffle positioned to divert flow of wellbore fluid away from a sheltered region in the annulus and into the tool body, the sheltered region being positioned adjacent to the tool body:

a ferrofluid isolator positioned on the tool body for retaining the ferrofluid in a region bounded at least in part by the ferrofluid isolator while obtaining resistivity readings: and a system control center programmed with instructions to:

arrange the ferrofluid in the annulus to control an electrically conductive path within the sheltered region in the annulus by at least one of:

providing commands to the ferrofluid source to introduce the ferrofluid; or providing commands to the magnet to produce the magnetic field.

15. The system of claim 14, further comprising a magnetometer positioned to detect a level of ferrofluid from the source in the annulus, wherein the system control center is programmed with instructions to arrange the ferrofluid at least in part based on the level detected by the magnetometer.

16. The system of claim 14, further comprising a ferrofluid collector positioned to collect ferrofluid from the source in the annulus, wherein the system control center is programmed with instructions to control the magnet in arranging the ferrofluid such that the ferrofluid from the source in the annulus is directed toward the ferrofluid collector.

17. A logging method comprising:

introducing, by a downhole assembly having a tool body for making resistivity measurements, a ferrofluid source, and a magnet, ferrofluid from the ferrofluid source into an annulus between the tool body and a wellbore formation;

magnetically coupling the ferrofluid with the magnet;

diverting wellbore fluid away from a sheltered region in the annulus and into the tool body, the sheltered region being positioned adjacent to the tool body:

retaining the ferrofluid in a region bounded at least in part by at least two ferrofluid isolators while obtaining resistivity readings: and arranging the ferrofluid to influence an electrically conductive path within the sheltered region in the annulus by controlling at least one of the ferrofluid source or the magnet.

18. The method of claim 17, wherein arranging the ferrofluid includes arranging the ferrofluid from the source to cause the ferrofluid to provide the electrically conductive path.

19. The method of claim 17, wherein arranging the ferrofluid includes arranging the ferrofluid from the source to cause the ferrofluid to provide an electrically resistive path as a boundary for the electrically conductive path.

20. The method of claim 17, wherein arranging the ferrofluid includes arranging the ferrofluid from the source to cause the electrically conductive path to span between the tool body and the wellbore formation.

21. The method of claim 17, wherein arranging the ferrofluid includes arranging the ferrofluid from the source to cause the electrically conductive path to span between a portion of the tool body and another portion of the tool body.

* * * * *